US011338416B2

(12) United States Patent
Hsieh

(10) Patent No.: US 11,338,416 B2
(45) Date of Patent: May 24, 2022

(54) ELECTRONIC TORQUE WRENCH WITH DOUBLE DISPLAY SCREENS

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 331 days.

(21) Appl. No.: 16/806,736

(22) Filed: Mar. 2, 2020

(65) Prior Publication Data

US 2020/0290186 A1 Sep. 17, 2020

(30) Foreign Application Priority Data

Mar. 11, 2019 (TW) ..... 108108086

(51) Int. Cl.
*B25B 23/142* (2006.01)

(52) U.S. Cl.
CPC ..... *B25B 23/1425* (2013.01)

(58) Field of Classification Search
CPC ..... B25B 23/14; B25B 23/1425
See application file for complete search history.

(56) References Cited

U.S. PATENT DOCUMENTS

2013/0199344 A1* 8/2013 Lee ..... B25B 23/1425 81/467

* cited by examiner

*Primary Examiner* — David B. Thomas
(74) *Attorney, Agent, or Firm* — Guice Patents PLLC

(57) ABSTRACT

An electronic torque wrench with double display screens includes a main body having a shank. A front end of the shank has a working head. The shank is defined with a central vertical face in the longitudinal direction. The electronic torque wrench further includes a display unit having two display screens. The two display screens are respectively disposed on two sides of the central vertical face. The two display screens are disposed by an inclination and directed upward and outward, whereby a user can easily observe the torque value displayed on the display screens.

8 Claims, 8 Drawing Sheets

ELECTRONIC TORQUE WRENCH WITH DOUBLE DISPLAY SCREENS

BACKGROUND OF THE INVENTION

1. Field of the Invention

The present invention relates to a hand tool, and more particularly to an electronic torque wrench with double display screens. The display screens are disposed on the electronic torque wrench by an inclination, whereby a user can easily laterally observe the torque value displayed on the display screens.

2. Description of the Related Art

The currently popularly used torque wrenches can be generally classified into two types, that is, mechanical torque wrench and electronic torque wrench. With respect to the mechanical torque wrench, a torque setting mechanism is often used to set the torque value. When the force applied by a user reaches the set value, the mechanical torque wrench will give a warning of move or sound to let the user know that the torque has reached the set value. However, the user cannot at any time know the current torque value in the operation process. The electronic torque wrench includes a shank, a sensation unit and a display screen. A working head is disposed at the front end of the shank. The sensation unit is disposed on the shank to detect the torque value applied to the working head. The torque value is displayed by the display screen. This is an advantage of the electronic torque wrench. In common arrangement, the display screen is often disposed on the top face of the shank, whereby when a user applies a force to the electronic torque wrench, the user can observe the display screen at the same time.

However, in practical use of the electronic torque wrench, when the user applies a force to the electronic torque wrench, the user will often stand beside the electronic torque wrench to hold the handle of the electronic torque wrench with one hand and operate the electronic torque wrench. In operation, the eyes of the user and the display screen of the electronic torque wrench will contain an angle so that the user can only obliquely observe the display screen. As a result, when the user observes the display screen, an angle difference exists and the user can hardly truly observe the display screen. Moreover, the torque value is displayed on the display screen in one fixed direction. In the case that the user observes the display screen in another force application direction, the user will see the numerals in reverse direction. This leads to inconvenience in use of the electronic torque wrench.

SUMMARY OF THE INVENTION

It is therefore a primary object of the present invention to provide an electronic torque wrench, which enables a user to easily observe the torque value data on the display screen.

It is a further object of the present invention to provide the above electronic torque wrench, which has double display screens, whereby the user can observe the torque value displayed on the display screens from both left and right sides.

To achieve the above and other objects, the electronic torque wrench with double display screens of the present invention includes:

a main body having a shank, a front end of the shank having a working head, the shank being defined with a central vertical face in the longitudinal direction; and a display unit having two display screens, the two display screens being obliquely disposed on the shank and respectively positioned on two sides of the central vertical face, each of the display screens having a top edge and a bottom edge, the top edge being spaced from the central vertical face by a first distance, the bottom edge being spaced from the central vertical face by a second distance, the first distance being smaller than the second distance, whereby the two display screens are upward and outward inclined.

Preferably, each display screens has a normal line. The normal lines of the two display screens and the central vertical face respectively contain an inclination angle ranging from 20 degrees to 70 degrees.

Preferably, the display directions of the two display screens are reverse to each other.

In the electronic torque wrench with double display screens of the present invention, the two display screens are disposed on the shank and respectively positioned on two sides of the central vertical face. Accordingly, when a user applies a force to rotate the shank, the user can observe the torque value change from the oblique upper side of two sides of the shank so that the user can more easily and truly read the torque value data.

The present invention can be best understood through the following description and accompanying drawings, wherein:

DETAILED DESCRIPTION OF THE PREFERRED EMBODIMENTS

Figure 1:
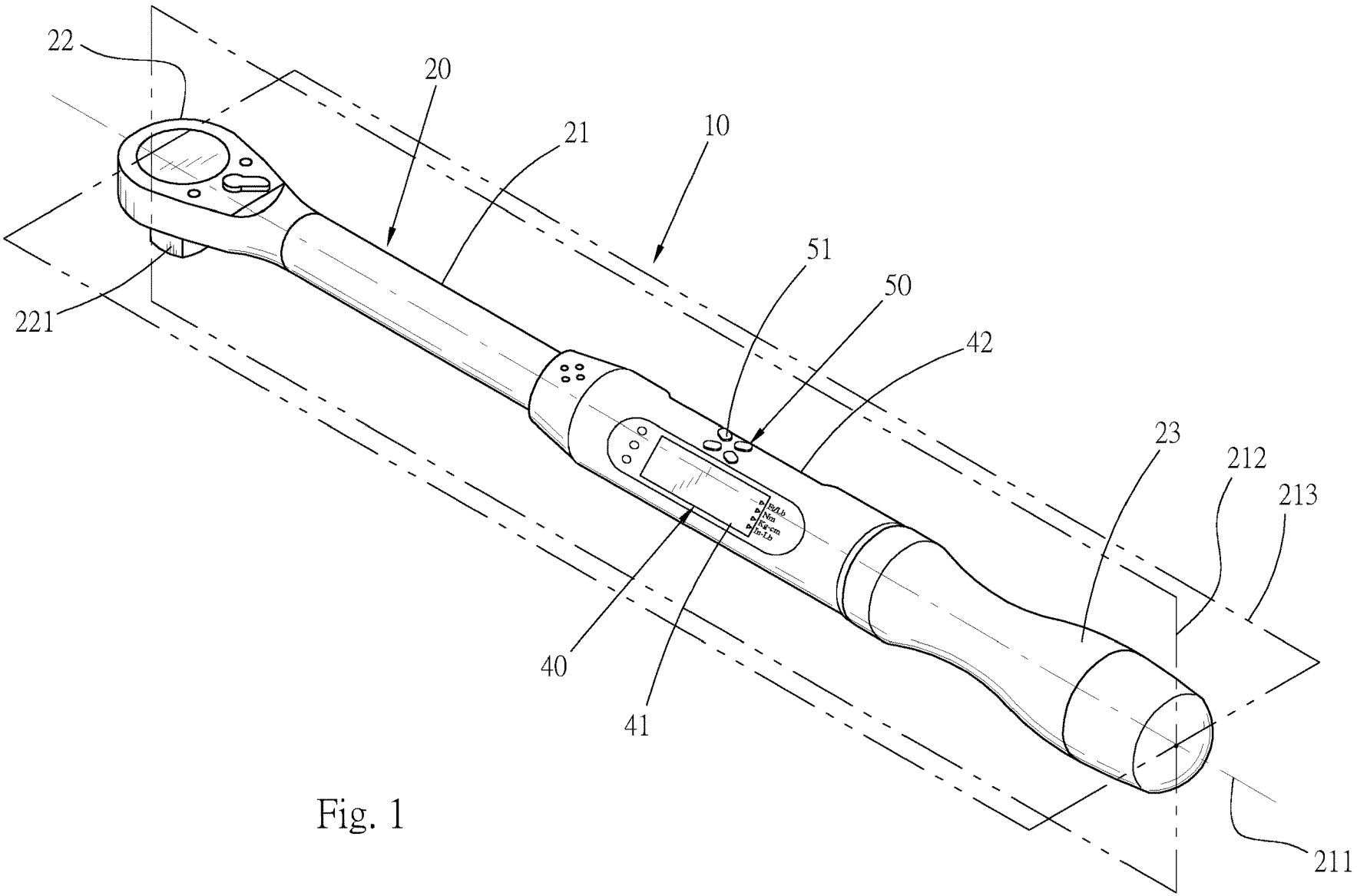
FIG. 1 is a perspective view of a first embodiment of the electronic torque wrench of the present invention.

Please refer to FIGS. 1 to 4. According to a first embodiment, the electronic torque wrench 10 with double display screens of the present invention includes a main body 20, a sensation unit 30 and a display unit 40. The main body 20 has a shank 21. A center of the shank 21 is defined with a central vertical face 212 in the longitudinal direction. The sensation unit 30 is disposed on the shank 21 to detect the torque value and show the torque value via the display unit 40. The display unit 40 has a first display screen 41 and a second display screen 42. The first and second display screens 41, 42 are disposed on upper side of the shank 21 and respectively positioned on two sides of the central vertical face 212. Accordingly, the first and second display screens 41, 42 are disposed by an inclination and directed upward and outward, whereby a user can obliquely observe the content shown by the display unit 40 from the top face of the shank 21.

Please further refer to FIGS. 1 to 4. shank. A working head 22 and a handle 23 are respectively formed at a front end and a rear end of the shank 21 of the main body 20. The center of the shank 21 is defined with an axis 211 from the working head 22 to the handle 23. The bottom face of the working head 22 is formed with an operation member 221 for engaging with a work piece. Alternatively, the working head can be formed with a polygonal fitting hole (not shown) for engaging with a work piece. The shank 21 is defined with a central vertical face 212 in the longitudinal direction with the axis 211 as the central line. The central vertical face 212 is normal to a force application plane 213.

Figure 2:
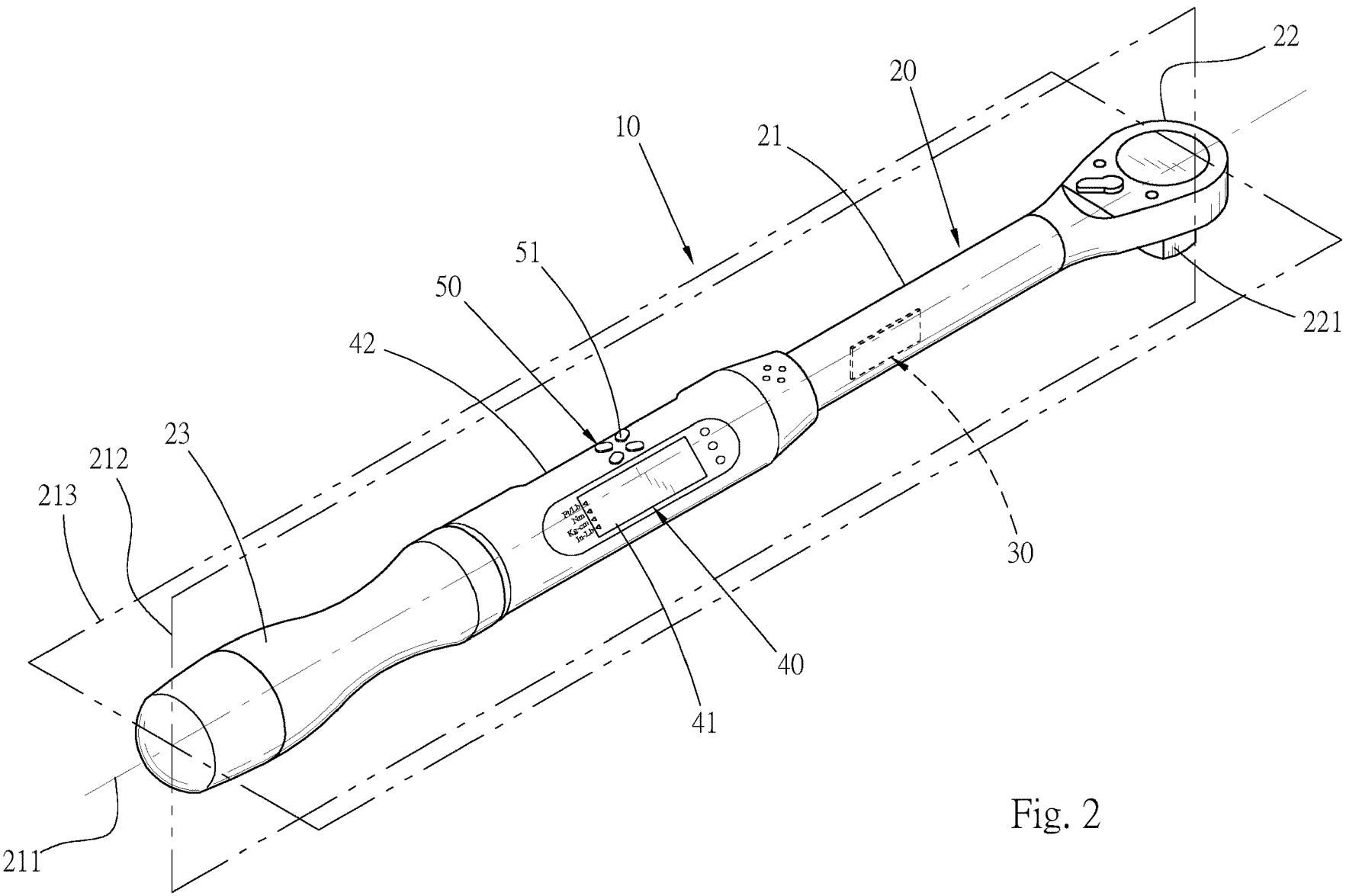
FIG. 2 is a perspective view of the first embodiment of the electronic torque wrench of the present invention, seen from the other side.

Please refer to FIG. 2. The sensation unit 30 is disposed on the shank 21 to detect the value of the torque applied to the shank 21.

Figure 3:
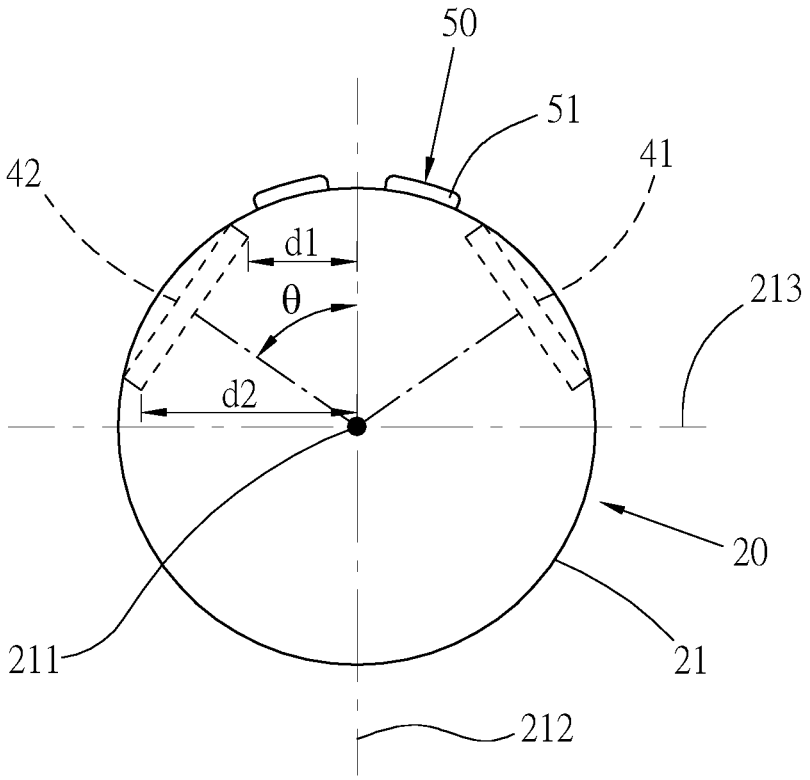
FIG. 3 is a sectional view showing that the two display screens of the display unit are arranged on the shank.
Figure 4:
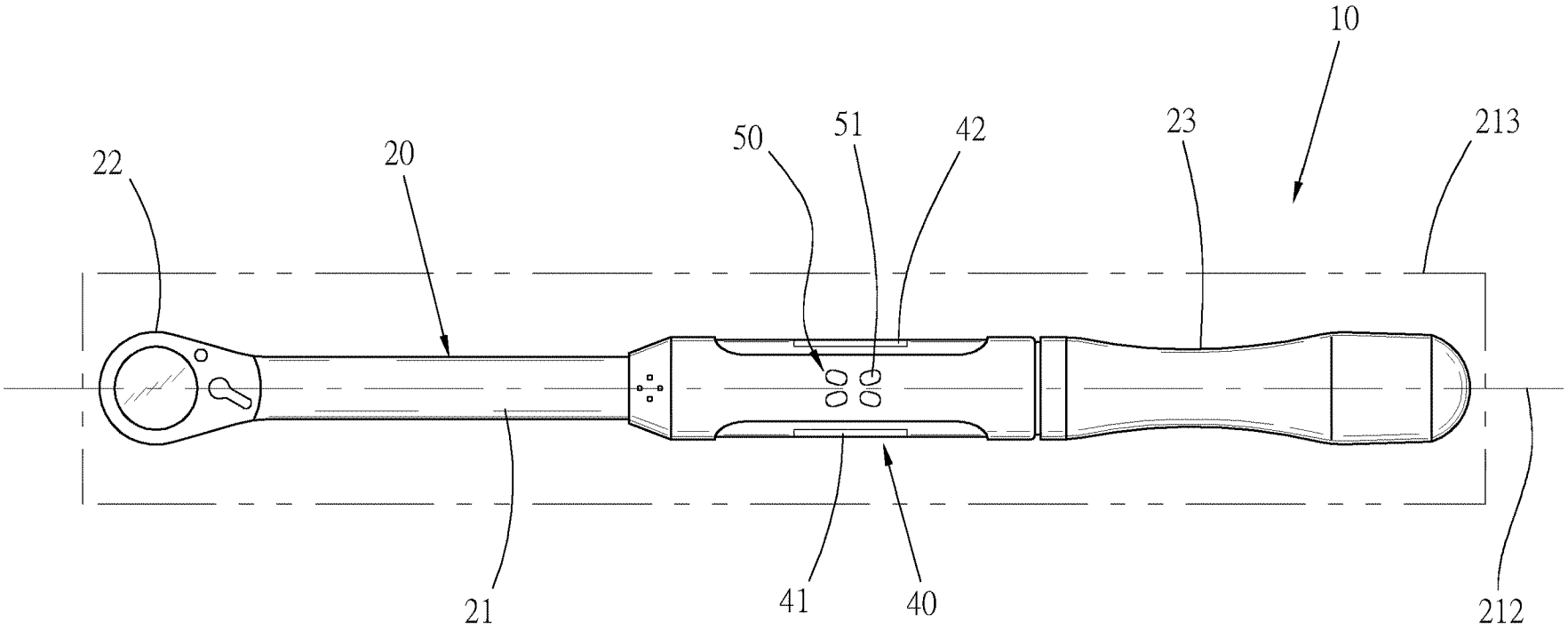
FIG. 4 is a top view of the electronic torque wrench of the present invention.

Please further refer to FIGS. 1 to 4. The display unit 40 is disposed on the shank 21 in adjacency to the handle 23. The first and second display screens 41, 42 are respectively disposed on two sides of the central vertical face 212. With reference to FIG. 4, the first and second display screens 41, 42 are obliquely disposed on the upper side of the shank 21. The first display screen 41 is mounted on the left side of the shank 21, while the second display screen 42 is mounted on the right side of the shank 21. Please refer to FIG. 3. Each of the first and second display screens 41, 42 has a normal line. The normal line and the central vertical face 212 contain an inclination θ ranging from about 20 degrees to 70 degrees. In addition, the display directions of the first and second display screens 41, 42 are reverse to each other. The upper and lower sides of the first display screen 41 are defined with a top edge 411 and a bottom edge 412. Also, the second display screen 42 is defined with a top edge 421 and a bottom edge 422. The top edge 411 (421) is spaced from the central vertical face 212 by a first distance d1. The bottom edge 412 (422) is spaced from the central vertical face 212 by a second distance d2. The two first distances d1 are smaller than the two second distances d2, whereby the first and second display screens 41, 42 are upward and outward inclined. The two display units 40 can receive the signal of the sensation unit 30 to display the torque value.

Figure 7:
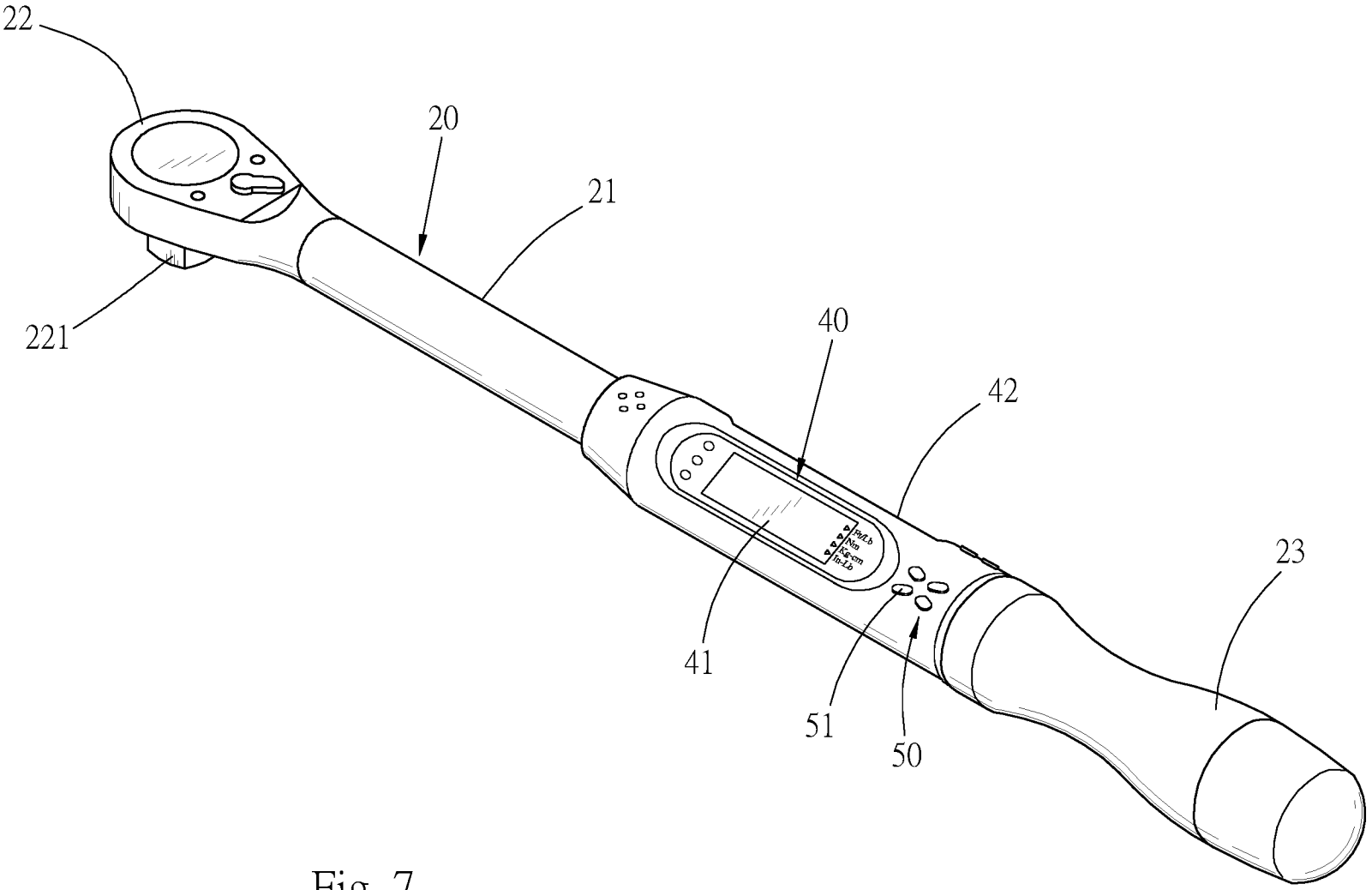
FIG. 7 is a perspective view of a second embodiment of the electronic torque wrench of the present invention, showing that the set of pushbuttons of the electronic torque wrench is disposed in adjacency to the handle side.
Figure 8:
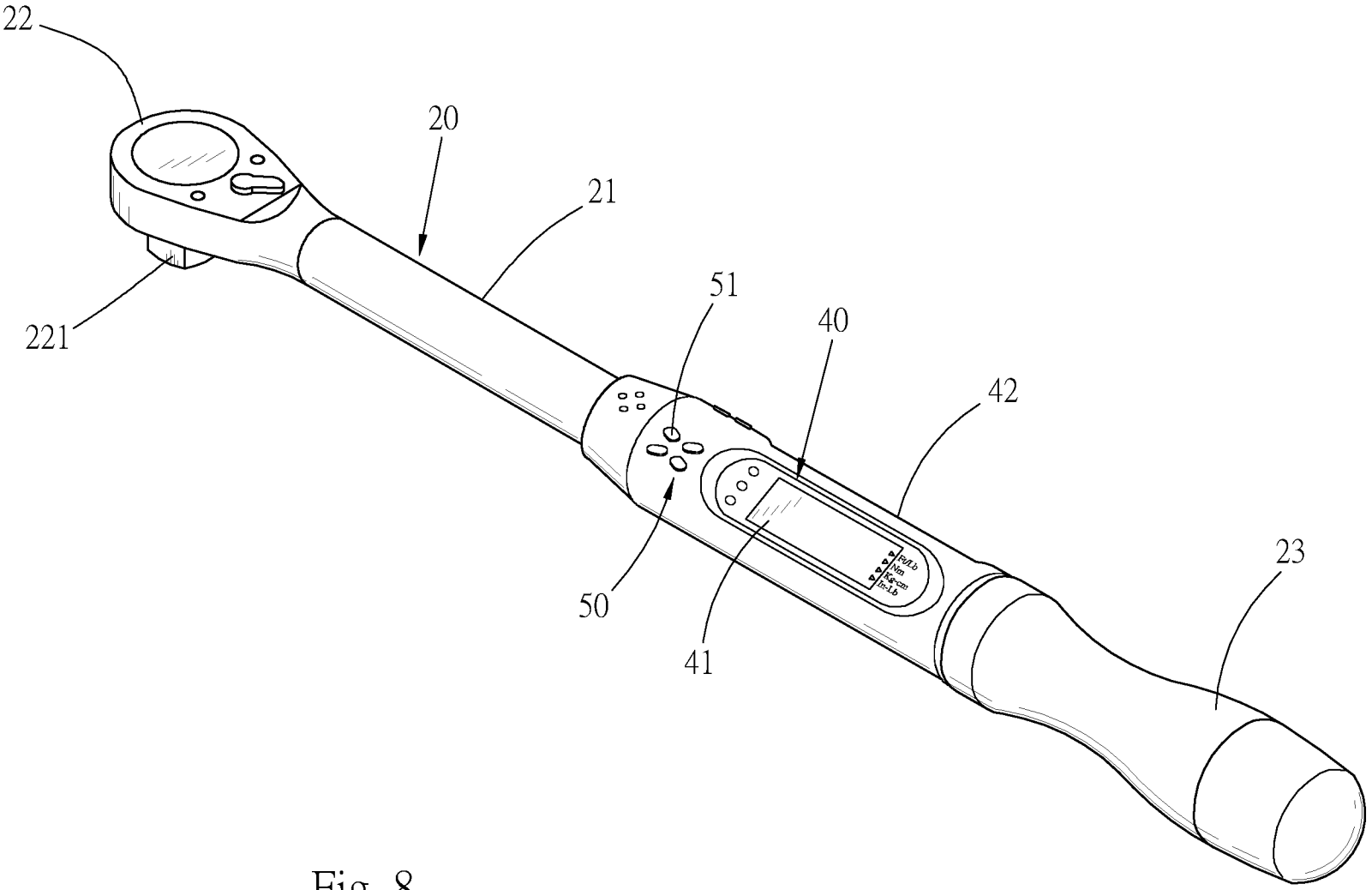
FIG. 8 is a perspective view of a third embodiment of the electronic torque wrench of the present invention, showing that the set of pushbuttons of the electronic torque wrench is disposed in adjacency to the working head side.

Please now refer to FIGS. 1 to 3. A set of pushbuttons 50 is disposed on the shank 21 and positioned between the top edge 411 of the first display screen 41 and the top edge 421 of the second display screen 42 and positioned at the top end of the shank 21. The set of pushbuttons 50 is composed of several pushbuttons 51 to provide different operations according to requirements. For example, the pushbuttons 51 serve to provide unit options, adjustment setting, screen locking, etc. In addition, as shown in FIGS. 7 and 8, which show a second embodiment and a third embodiment of the torque wrench of the present invention, there are two sets of pushbuttons 50 respectively corresponding to the first and second display screens 41, 42. The two sets of pushbuttons 50 are disposed at two ends of the display unit 40 in adjacency to the handle 23 or the working head 22 for easy operation. Moreover, the two sets of pushbuttons 50 can be disposed at the same end or different ends of the display unit 40.

Figure 5:
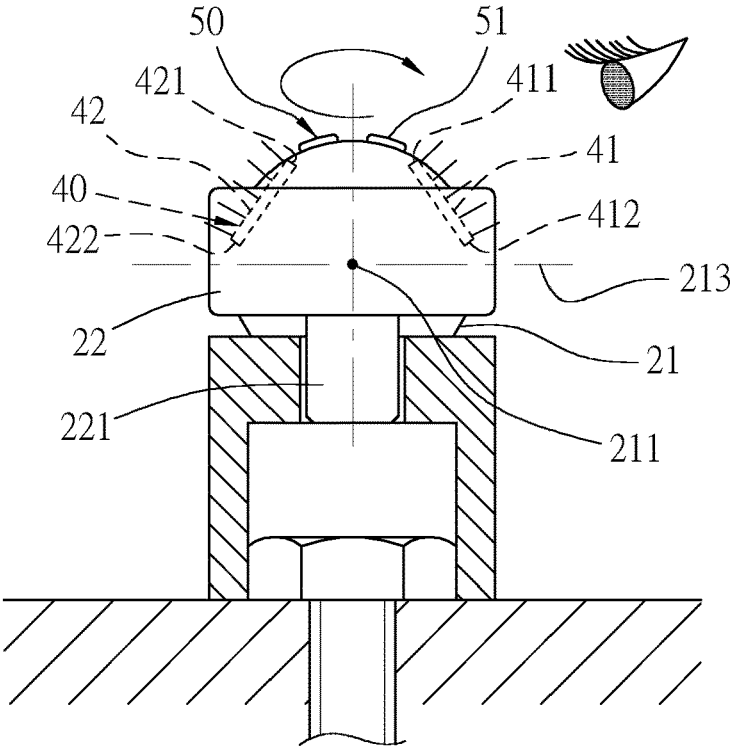
FIG. 5 is a view showing that when the electronic torque wrench is clockwise forced, a user observes the first display screen.
Figure 6:
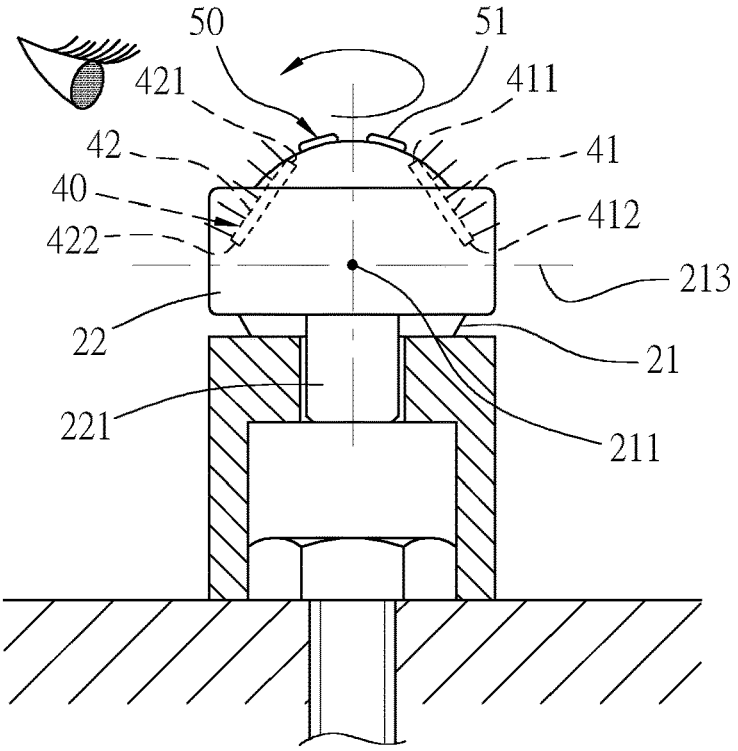
FIG. 6 is a view showing that when the electronic torque wrench is counterclockwise forced, the user observes the second display screen.

Please refer to FIGS. 5 and 6. In practical operation and use, when a user applies a force to the electronic torque wrench 10, the electronic torque wrench 10 is spaced from the body by a certain distance. When the user's arm applies a force to the electronic torque wrench 10 to rotate the handle 23 of the main body 20, the force is transmitted to the operation member 221 of the working head 22 in the direction of the force application plane 213, whereby the operation member 221 drives the work piece to rotate. At this time, the sightline of the user and the main body 20 will contain an angle. Therefore, the inclined display unit 40 can provide a better observation angle for the user to easily and quickly observe the operation data such as the torque value. Furthermore, the value can be only displayed on the first display screen 41 or the second display screen 42, whereby the value is shown on one single screen. Alternatively, the user can operate the set of pushbuttons 50 to control the value to be displayed on the first display screen 41 or the second display screen 42 or displayed on both the first display screen 41 and the second display screen 42. Please refer to FIG. 5. When the user clockwise applies the force, the first display screen 41 is near the user so that the torque value can be displayed on the first display screen 41, whereby the user can obliquely and clearly observe the value displayed on the first display screen 41. Reversely, as shown in FIG. 6, when the user counterclockwise applies the force, the second display screen 42 is near the user so that the torque value can be displayed on the second display screen 42, whereby the user can observe the torque value change from the second display screen 42.

Figure 9:
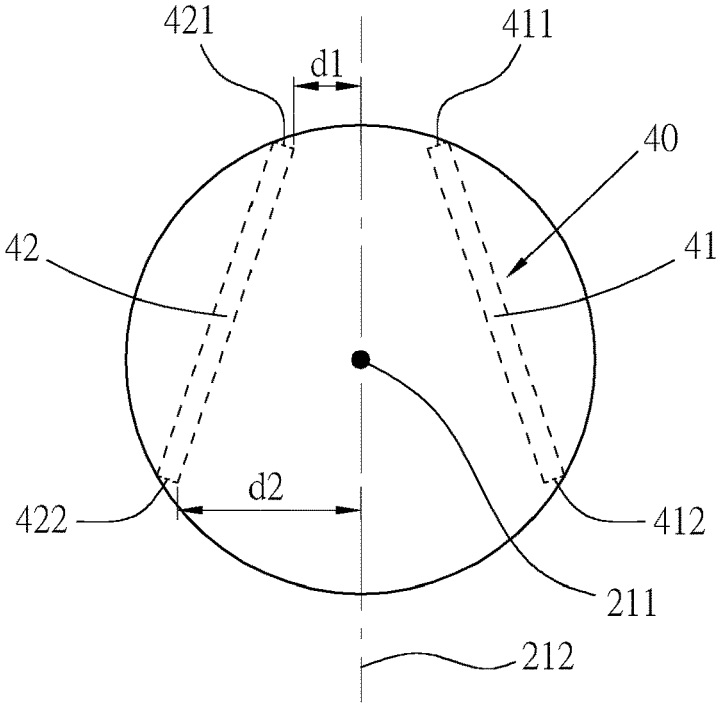
FIG. 9 is a sectional view of a fourth embodiment of the electronic torque wrench of the present invention, showing that the second display screen of the display unit of the electronic torque wrench is disposed over the axis of the shank.

Please now refer to FIG. 9, which shows a fourth embodiment of the torque wrench of the present invention. The main structure of the fourth embodiment is identical to the first embodiment and thus will not be redundantly described hereinafter. In the fourth embodiment, the first display screen 41 and the second display screen 42 of the display unit 40 are disposed over the axis 211 of the shank 21, whereby the display unit 40 can provide a display effect with larger area.

Figure 10:
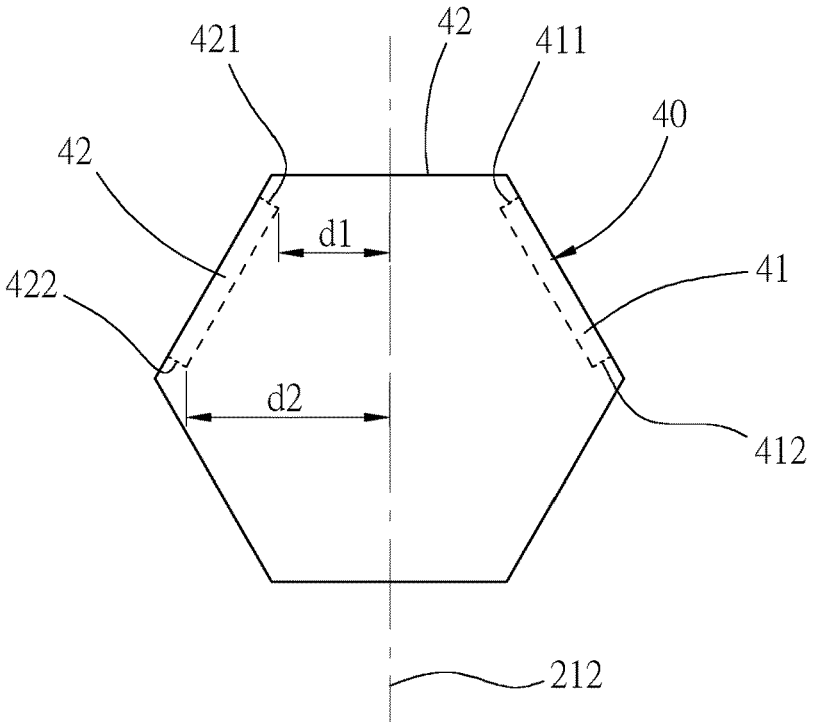
FIG. 10 is a sectional view of a fifth embodiment of the electronic torque wrench of the present invention, showing that the shank of the electronic torque wrench has a hexagonal configuration and the two display screens of the display unit are respectively disposed on two lateral sides of the upper side of the shank.

Please now refer to FIG. 10, which shows a fifth embodiment of the torque wrench of the present invention. The main structure of the fifth embodiment is identical to the first embodiment and thus will not be redundantly described hereinafter. In the fifth embodiment, the shank 21 has a hexagonal configuration and the first display screen 41 and the second display screen 42 of the display unit 40 are disposed on two lateral sides of the upper side of the shank 21.

In the conventional electronic torque wrench, the torque value is simply displayed on the top face so that a user must adjust the observation position to observe the torque value displayed on the top. In addition, when observing the torque value in a reverse direction, the user will mis-read the value. In comparison with the conventional electronic torque wrench, the electronic torque wrench 10 of the present invention has two display screens obliquely disposed on two sides of the shank. Therefore, when a user applied a force to the torque wrench, the display screens can provide an easy observation angle so that the user is unnecessary to change the sight angle and can truly read the value from both sides. This enhances the convenience and observability of the torque wrench.

The above embodiments are only used to illustrate the present invention, not intended to limit the scope thereof. Many modifications of the above embodiments can be made without departing from the spirit of the present invention.

What is claimed is:

1. An electronic torque wrench with double display screens, comprising:

a main body having a shank, a front end of the shank having a working head, a center of the shank being defined with a central vertical face in the longitudinal direction; and a display unit having two display screens, the two display screens being obliquely disposed on the shank and respectively positioned on two sides of the central vertical face, each of the display screens having a top edge and a bottom edge, the top edge being spaced from the central vertical face by a first distance, the bottom edge being spaced from the central vertical face by a second distance, the first distance being smaller than the second distance.

2. The electronic torque wrench as claimed in claim 1, further comprising at least one set of pushbuttons disposed on the main body, the set of pushbuttons being composed of several pushbuttons.

3. The electronic torque wrench as claimed in claim 2, wherein the at least one set of pushbuttons is disposed between the top edges of the two display screens.

4. The electronic torque wrench as claimed in claim 2, wherein there are two sets of pushbuttons, the two display screens having two ends, one end of which being directed to the working head, the other end being away from the working head, the two sets of pushbuttons being respectively positioned at one end of the two display screens.

5. The electronic torque wrench as claimed in claim 4, wherein the two sets of pushbuttons are positioned at the same end of the two display screens.

6. The electronic torque wrench as claimed in claim 4, wherein the two sets of pushbuttons are positioned at different ends of the two display screens.

7. The electronic torque wrench as claimed in claim 1, wherein the display screens are disposed on two sides of the shank, each of the display screens having a normal line, the normal line of the display screen and the central vertical face containing an angle ranging from 20 degrees to 70 degrees.

8. The electronic torque wrench as claimed in claim 1, wherein the display directions of the two display screens are reverse to each other.

* * * * *